US007648135B2

(12) United States Patent
Matsushima

(10) Patent No.: US 7,648,135 B2
(45) Date of Patent: Jan. 19, 2010

(54) IMAGE-FORMING APPARATUS

(75) Inventor: Ryoichi Matsushima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 57 days.

(21) Appl. No.: 11/928,938

(22) Filed: Oct. 30, 2007

(65) Prior Publication Data

US 2008/0099978 A1 May 1, 2008

(30) Foreign Application Priority Data

Oct. 31, 2006 (JP) ..... 2006-295915

(51) Int. Cl.
*B65H 1/00* (2006.01)

(52) U.S. Cl. ..... 271/171; 271/162; 271/164; 271/145

(58) Field of Classification Search ..... 271/171, 271/162, 164, 145
See application file for complete search history.

(56) References Cited

U.S. PATENT DOCUMENTS

| | | | | |
|---|---|---|---|---|
| 4,030,725 | A * | 6/1977 | Fukui et al. | 271/164 |
| 4,444,386 | A * | 4/1984 | Murata et al. | 271/127 |
| 4,864,368 | A * | 9/1989 | Muramatsu | 399/402 |
| 5,126,580 | A * | 6/1992 | Hiraoka et al. | 250/559.15 |
| 5,327,206 | A * | 7/1994 | Ueda et al. | 399/402 |
| 6,073,925 | A * | 6/2000 | Sato | 271/171 |
| 6,364,309 | B1 * | 4/2002 | Tomatsu | 271/160 |
| 6,435,499 | B1 * | 8/2002 | Tomatsu | 271/147 |
| 6,619,656 | B2 * | 9/2003 | Guddanti et al. | 271/171 |
| 6,826,383 | B2 * | 11/2004 | Yano | 399/389 |
| 7,154,639 | B2 * | 12/2006 | Chien | 358/474 |
| 7,434,801 | B2 * | 10/2008 | Yang | 271/171 |
| 7,448,613 | B2 * | 11/2008 | Takahashi | 271/157 |
| 2003/0116907 | A1 * | 6/2003 | Pearce et al. | 271/145 |
| 2005/0133983 | A1 * | 6/2005 | Jacobs et al. | 271/145 |
| 2008/0012207 | A1 * | 1/2008 | Allwright et al. | 271/145 |

FOREIGN PATENT DOCUMENTS

| | | |
|---|---|---|
| JP | 02-235072 | 9/1990 |
| JP | 2001-310824 | 11/2001 |
| JP | 2005-037837 | 2/2005 |
| JP | 2006-117339 | 5/2006 |

* cited by examiner

*Primary Examiner*—Patrick H Mackey
*Assistant Examiner*—Prasad V Gokhale
(74) *Attorney, Agent, or Firm*—Banner & Witcoff, Ltd

(57) ABSTRACT

A body section of an image-forming apparatus accommodates a sheet cassette such that the sheet cassette can be drawn out along a first direction. The sheet cassette has a sheet-position-limiting member. When the sheet cassette is empty of image-recording media, the sheet-position-limiting member is moved in the first direction to a predetermined initial position. When the sheet cassette is drawn out in the first direction, the sheet-position-limiting member moves in a second direction in relation to the sheet cassette. The body section and the sheet cassette are configured such that the sheet-position-limiting member is positioned according to the amount of drawing of the sheet cassette.

10 Claims, 8 Drawing Sheets

IMAGE-FORMING APPARATUS

CROSS-REFERENCE TO RELATED APPLICATION

This application claims priority from Japanese Patent Application No. 2006-295915, filed on Oct. 31, 2006, the entire subject matter of which is incorporated herein by reference.

BACKGROUND OF THE INVENTION

1. Field of the Invention

The present invention relates to an image-forming apparatus.

2. Description of the Related Art

Conventionally, there is known an image-forming apparatus having a paper-feeding cassette for stacking paper (image-recording media) therein. The paper-feeding cassette usually has a rear-end guide for guiding the rear end of paper (as disclosed in, for example, Japanese Patent Application Laid-Open (kokai) Nos. 2001-310824 and 2006-117339).

A paper-feed cassette of this kind is configured so as to allow the position of the rear-end guide to be changed in a front-rear direction according to a difference in the rear-end position of paper among sizes of paper.

When the size of paper is to be changed, an image-forming apparatus of this kind requires a user to carry out the following manual operations: (1) to draw out the paper-feeding cassette from the body section of the image-forming apparatus; (2) to adjust the position of the rear-end guide for paper of a desired size; (3) to place paper of the desired size in the paper-feeding cassette; and (4) to insert the paper-feeding cassette into the body section.

These manual operations (particularly, an operation of adjusting the position of the rear-end guide) are very troublesome. For example, the configuration disclosed in Japanese Patent Application Laid-Open (kokai) No. 2001-310824 requires the following troublesome operation: the user once removes the rear-end guide from the paper-feeding cassette and then attaches the rear-end guide to the paper-feeding cassette at a position corresponding to a desired size of paper.

Also, the configuration disclosed in Japanese Patent Application Laid-Open (kokai) No. 2006-117339 requires the following troublesome operation: the user once unlocks the rear-end guide from the paper-feeding cassette; slides the rear-end guide to a position corresponding to a desired size of paper; and then locks the rear-end guide to the paper-feeding cassette.

Particularly, in the configuration disclosed in Japanese Patent Application Laid-Open (kokai) No. 2001-310824, the rear-end guide is located on the far side of the paper-feeding cassette. This renders more troublesome an operation of adjusting the position of the rear-end guide.

SUMMARY OF THE INVENTION

An object of the present invention is to provide an image-forming apparatus in which an operation for changing sizes of paper (image-recording media) is further simplified.

An image-forming apparatus of the present invention comprises a sheet cassette and a body section. The sheet cassette can contain sheets of image-recording media in a stacked condition. The body section can accommodate the sheet cassette. The body section allows the sheet cassette to be drawn out along a first direction.

The sheet cassette comprises a cassette body and a sheet-position-limiting member.

The cassette body is formed into a box-like shape. The sheet-position-limiting member can be positioned according to the size of the image-recording media contained in the cassette body.

Specifically, the cassette body and the sheet-position-limiting member are configured such that the sheet-position-limiting member can move in relation to the cassette body in the first direction or a second direction opposite the first direction.

For example, the cassette body may comprise a bottom plate and side plates, which stand upward from respective end portions of the bottom plate. The sheet-position-limiting member may be slidably attached to the bottom plate.

The body section comprises limiting-member-position-initializing means and limiting-member-positioning means.

When the sheet cassette is empty of the image-recording media, the limiting-member-position-initializing means can move the sheet-position-limiting member in the first direction to a predetermined initial position.

The limiting-member-positioning means can position the sheet-position-limiting member according to the amount of drawing of the sheet cassette. Specifically, when the sheet cassette is drawn out in the first direction with the sheet-position-limiting member positioned at the initial position, the limiting-member-positioning means can move the sheet-position-limiting member in the second direction in relation to the sheet cassette.

For example, the image-forming apparatus may be configured as follows: the sheet-position-limiting member comprises a rack gear extending along the first direction; the limiting-member-position-initializing means comprises a pinion gear corresponding to the rack gear; and the limiting-member-position-initializing means is configured such that the pinion gear is meshed with the rack gear when the sheet cassette is empty of the image-recording media.

Also, for example, the limiting-member-positioning means may comprise a stopper member. The stopper member can butt against the sheet-position-limiting member when the sheet cassette is drawn out in the first direction.

In the thus-configured image-forming apparatus of the present invention the limiting-member-position-initializing means moves the sheet-position-limiting member in the first direction when the sheet cassette is empty of the image-recording media. This causes the sheet-position-limiting member to move to the initial position.

Subsequently, with the sheet-position-limiting member positioned at the initial position, the sheet cassette is drawn out in the first direction. By this procedure, the limiting-member-positioning means causes the sheet-position-limiting member to move in relation to the sheet cassette in the second direction. The sheet-position-limiting member is positioned according to the amount of drawing of the sheet cassette.

According to this configuration, merely by adjusting the amount of drawing of the sheet cassette, the sheet-position-limiting member is positioned. That is, a manual operation performed by a user for changing sizes of the image-recording media can be completed merely by drawing of the sheet cassette, which is a minimal requisite for changing the sizes.

Thus, the present invention can further simplify an operation for changing sizes of the image-recording media.

The limiting-member-positioning means may be configured such that the stopper member can be selectively positioned at either a first position or a second position. The first position is where the stopper member can butt against the sheet-position-limiting member when the sheet cassette is drawn out in the first direction. The second position is where the stopper member cannot butt against the sheet-position-limiting member when the sheet cassette is drawn out in the first direction.

According to this configuration, when the sheet cassette is drawn out in the first direction with the stopper member positioned at the first position, the stopper member and the sheet-position-limiting member butt against each other. Thus, the sheet-position-limiting member can be positioned according to the amount of drawing of the sheet cassette.

Meanwhile, with the stopper member positioned at the second position, drawing the sheet cassette in the first direction does not cause the stopper member and the sheet-position-limiting member to butt against each other.

Accordingly, when the sheet cassette is to be removed from the body section or when the sheet cassette is to be replenished with the image-recording media of the same size without changing the size, the stopper member can be positioned at the second position. By virtue of this, an operation of removing the sheet cassette from the body section, an operation of replenishing the sheet cassette with the image-recording media of the same size, and a like operation can be carried out in a simpler manner.

The sheet cassette may comprise size indications. The size indications indicate the relationship between the amounts of drawing of the sheet cassette and the positions of the sheet-position-limiting member corresponding to standard sizes of the image-recording media.

This configuration can render simpler an operation of adjusting the amount of drawing of the sheet cassette.

The image-forming apparatus may be configured such that the sheet cassette comprises recesses and the body section comprises a projection to be engaged with any one of the recesses.

This configuration can render simpler and more reliable an operation of adjusting the amount of drawing of the sheet cassette.

DESCRIPTION OF THE PREFERRED EMBODIMENT

An embodiment of the present invention (the best mode contemplated by the inventors at the time of filing the present application) will next be described in detail with reference to the drawings.

<Overall Configuration of Laser Printer>

Figure 1:
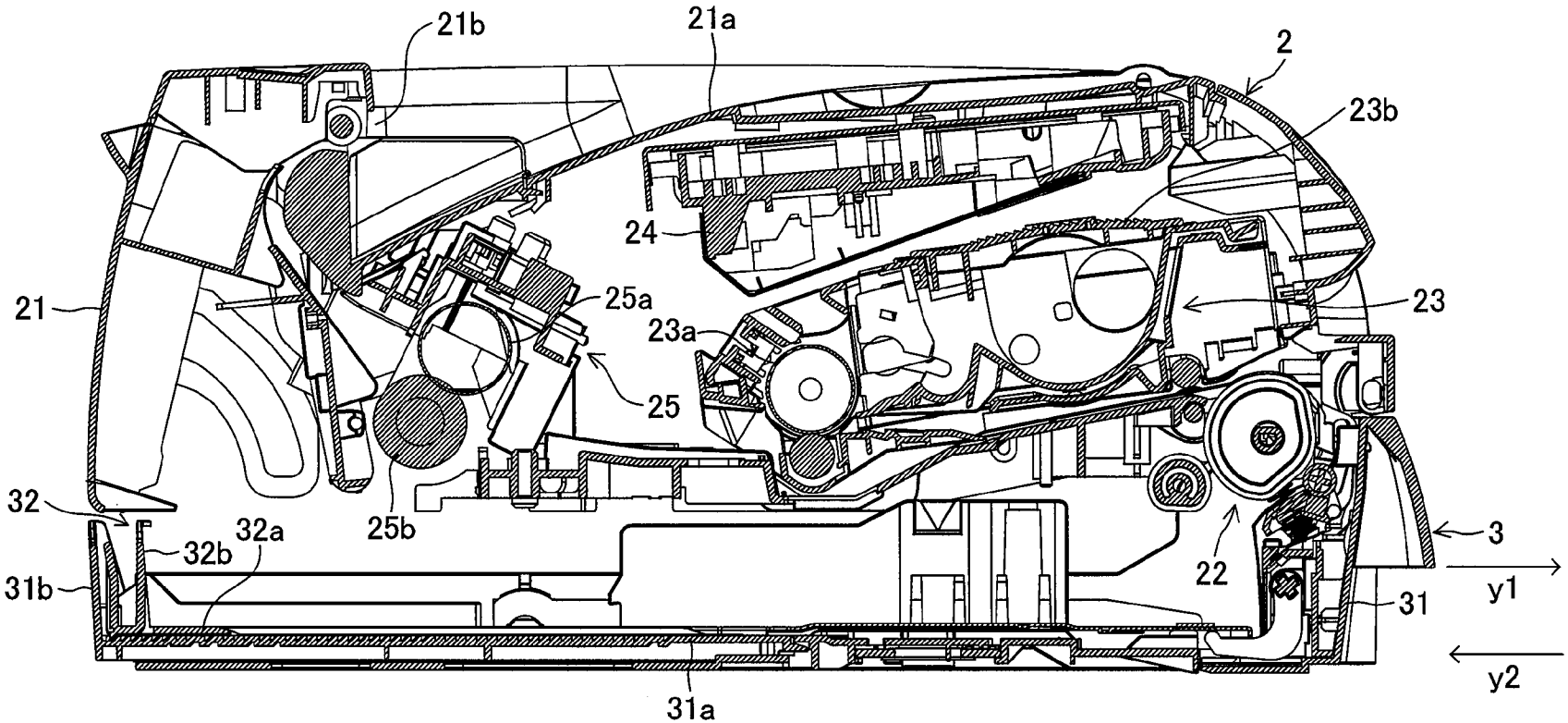
FIG. 1 is a side sectional view (a central sectional view as viewed from the left side) showing a schematic configuration of a laser printer according to an embodiment of the present invention.

FIG. 1 (a central sectional view as viewed from the left side) sectionally shows the schematic configuration of a laser printer 1 according to an embodiment of the present invention as viewed from the side.

The left-right direction in FIG. 1 is referred to as the printer front-rear direction. With respect to the printer front-rear direction, a side toward one end of the laser printer 1 (the right side in FIG. 1) is referred to as the "front side," and a side toward the other end (the left side in FIG. 1) is called the "far side." A direction orthogonal to both of the printer front-rear direction and a vertical direction is referred to as the paper width direction (a direction perpendicular to the paper on which FIG. 1 appears).

Referring to FIG. 1, the laser printer 1 includes a body section 2 and a sheet cassette 3.

The body section 2 is configured such that the sheet cassette 3 can be removed therefrom by means of drawing out the sheet cassette 3 in a first direction y1 (rightward in FIG. 1). The body section 2 is also configured such that the sheet cassette 3 can be attached thereto (accommodated therein) by means of pushing in the sheet cassette 3 in a second direction y2 (leftward in FIG. 1). As shown in FIG. 1, the first direction y1 and the second direction y2 are in parallel with the printer front-rear direction and are opposite each other.

The sheet cassette 3 is accommodated in a lower portion of the body section 2. The sheet cassette 3 can contain a large number of sheets of image-recording media in a stacked condition. Specifically, the sheet cassette 3 in the present embodiment can contain about 300 to 500 sheets (the number of sheets depends on the thickness of an image-recording medium) of image-recording media of up to A4 size (210 mm width×297 mm length) in portrait orientation (in which the longitudinal direction of the image-recording media coincides with the printer front-rear direction).

That is, the sheet cassette 3 in the present embodiment has a length corresponding to the length of image-recording media of A4 size. The sheet cassette 3 in the present embodiment has a width corresponding to the width of image-recording media of A4 size.

<<Schematic Configuration of Body Section>>

The body section 2 has a body casing 21. The body casing 21 is a member which is formed from a synthetic resin plate and serves as an outer cover for covering various mechanisms provided in the body section 2.

A catch tray 21*a* is provided at an upper portion of the body casing 21. The upper surface of the body casing 21 serves as the catch tray 21*a*. The catch tray 21*a* has a slope which extends downward from the near side to the far side. In other words, an upper portion of the body casing 21 has a recess which opens upward, and the bottom surface of the recess serves as the catch tray 21*a*.

The body casing 21 has a paper ejection port 21*b* formed at an upper portion thereof. The paper ejection port 21*b* is a slit-like opening whose longitudinal direction is along the paper width direction. The paper ejection port 21*b* is located above a far end portion (a lowest portion) of the catch tray 21*a*.

The body casing 21 accommodates a paper feed mechanism 22. The paper feed mechanism 22 has a roller-like member which is rotatably driven by an unillustrated main motor. The paper feed mechanism 22 can feed image-recording media contained in the sheet cassette 3 one by one toward a process cartridge 23, which will be described later. In the present embodiment, the paper feed mechanism 22 is disposed at a lower, near end portion of the body casing 21 in such a manner as to face the sheet cassette 3.

The body casing 21 accommodates the process cartridge 23 located above the sheet cassette 3. The process cartridge 23 in the present embodiment includes a photoconductor drum 23*a* and a developing unit 23*b*.

The photoconductor drum 23*a* is a substantially cylindrical member and includes a metal pipe of aluminum or the like and a photoconductor layer, which is formed on the metal pipe and serves as an outer circumferential portion of the photoconductor drum 23*a*. The photoconductor drum 23*a* is disposed in parallel with the paper width direction. An electrostatic latent image can be formed on the outer circumferential surface of the photoconductor drum 23*a*.

The developing unit 23*b* is disposed in such a manner as to face the outer circumferential surface of the photoconductor drum 23*a*. The developing unit 23*b* can feed a charged dry developing agent (hereinafter called "toner") to the outer circumferential surface of the photoconductor drum 23*a* on which an electrostatic latent image has been formed, whereby toner can adhere to the outer circumferential surface in a pattern corresponding to the electrostatic latent image. In this manner, the developing unit 23*b* can develop the electrostatic latent image on the outer circumferential surface of the photoconductor drum 23*a*.

The process cartridge 23 is configured such that toner adhering to the outer circumferential surface of the photoconductor drum 23*a* can be transferred onto an image-recording medium.

In the interior of the body casing 21, an exposure unit 24 is disposed above the process cartridge 23. The exposure unit 24 can irradiate the outer circumferential surface of the photoconductor drum 23*a* with a laser beam which is modulated according to image data, whereby an electrostatic latent image can be formed on the outer circumferential surface.

In the interior of the body casing 21, a fixation unit 25 is disposed downstream of the process cartridge 23 with respect to an image-recording-medium transport direction. The fixation unit 25 can apply pressure and heat to an image-recording medium which comes from the process cartridge 23 and to which toner adheres, whereby a toner image can be fixed on the image-recording medium.

Specifically, the fixation unit 25 includes a heat roller 25*a* and a press roller 25*b*.

The heat roller 25*a* includes a cylindrical member made of a metal and a halogen lamp contained within the cylindrical member and can generate heat while being rotatably driven. The press roller 25*b* is formed from silicone rubber and can rotate to follow the heat roller 25*a* while being pressed against the heat roller 25*a* under a predetermined pressure.

<Detailed Configuration of Sheet Cassette>

Figure 2:
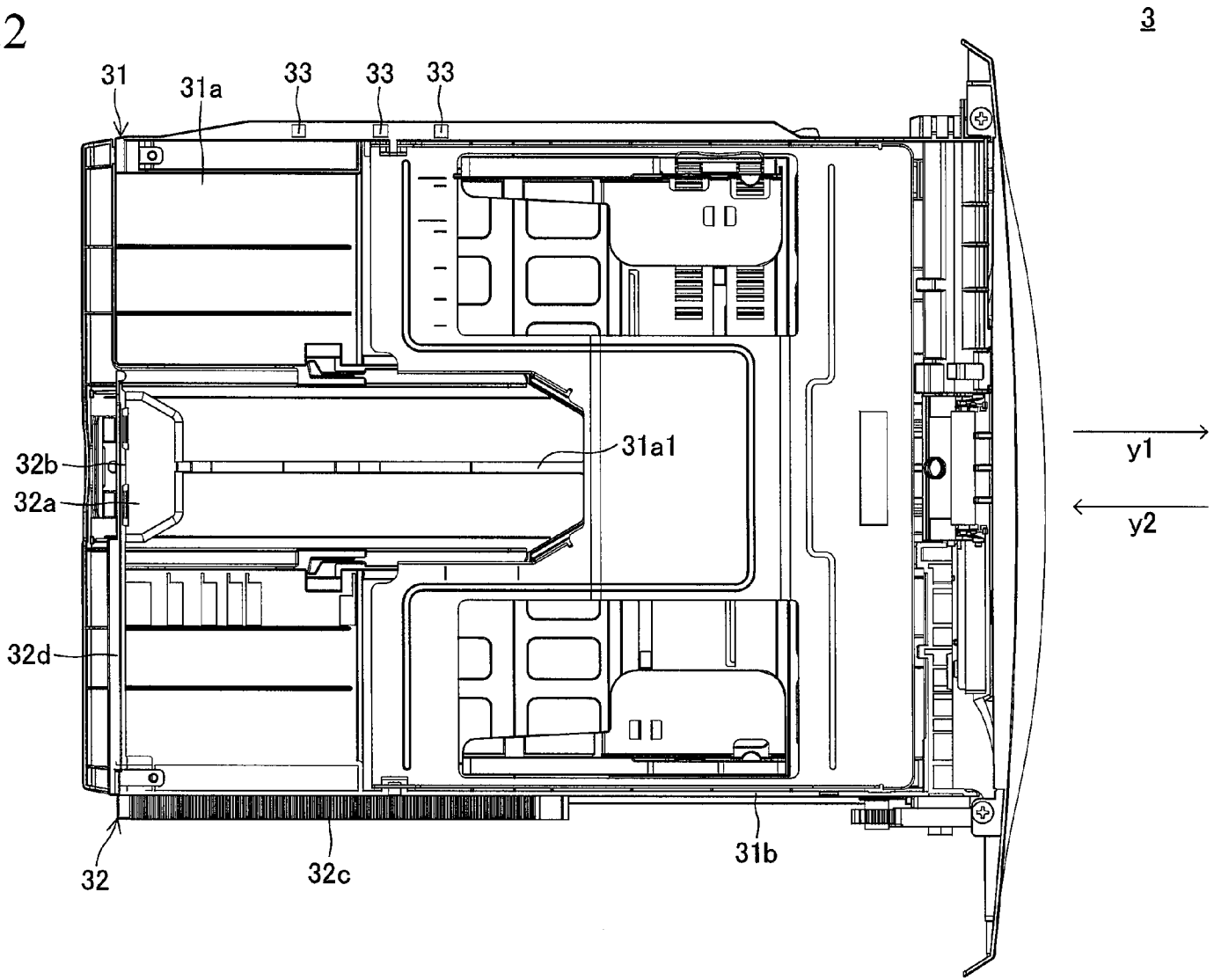
FIG. 2 is a plan view of a sheet cassette shown in FIG. 1.
Figure 3:
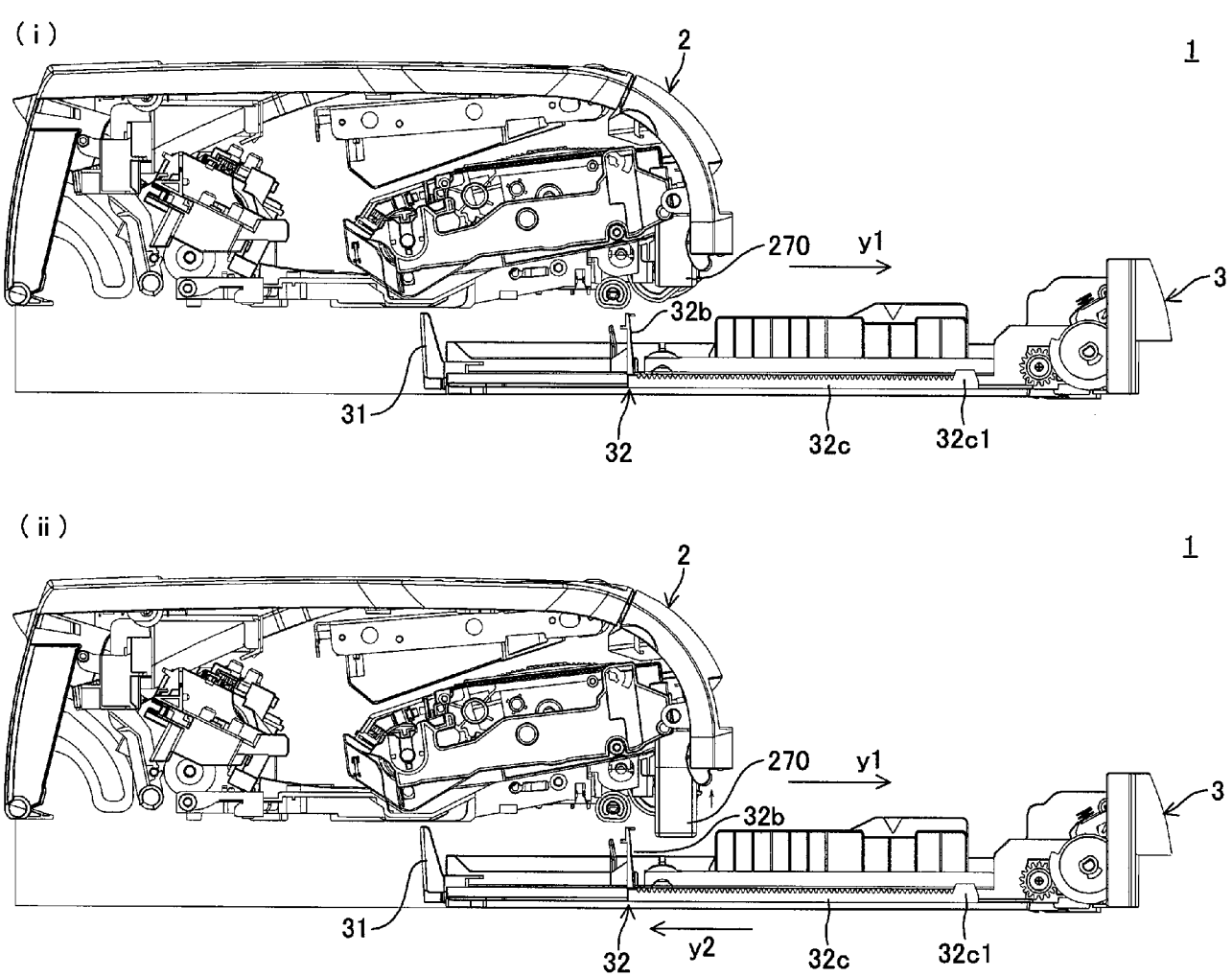
FIG. 3 is a side see-through view of the laser printer of FIG. 1, showing a state in which the sheet cassette is drawn out from a body section.

FIG. 2 shows, in plane, the sheet cassette 3 shown in FIG. 1. FIG. 3 shows, as viewed from the side and in a see-through manner, the laser printer 1 of FIG. 1 in a state in which the sheet cassette 3 is drawn out from the body section 2. The configuration of the sheet cassette 3 will next be described in detail with reference to FIGS. 1 to 3.

The sheet cassette 3 has a box-like cassette body 31, which opens upward. Specifically, the cassette body 31 has a bottom plate 31*a* and side plates 31*b*. The bottom plate 31*a* has a guide groove 31*a*1 formed at substantially the center with respect to the paper width direction. The guide groove 31*a*1 is in parallel with the printer front-rear direction and extends from a far end portion of the bottom plate 31*a* to substantially a central portion of the bottom plate 31*a* with respect to the printer front-rear direction. The side plates 31*b* stand upward from respective end portions of the bottom plate 31*a*.

The sheet cassette 3 has a sheet-position-limiting member 32. The sheet-position-limiting member 32 is positioned according to the size of image-recording media contained in the cassette body 31, thereby positionally limiting the rear ends (left-side ends in FIG. 2) of image-recording media contained in the cassette body 31. The sheet-position-limiting member 32 is slidably attached to the bottom plate 31*a*.

That is, the cassette body 31 and the sheet-position-limiting member 32 are configured such that the sheet-position-limiting member 32 can move in relation to the cassette body 31 in the first direction y1 or the second direction y2.

FIGS. 1 and 2 show the position of the sheet-position-limiting member 32 when paper of A4 size is placed in portrait orientation in the sheet cassette 3. FIG. 3 shows the initial position of the sheet-position-limiting member 32. In the present embodiment, the initial position is the position of the sheet-position-limiting member 32 when paper of A5 size is placed in portrait orientation.

The sheet-position-limiting member 32 in the present embodiment includes a slide plate 32*a*, a rear-end stopper plate 32*b*, a rack gear 32*c*, and a tie bar 32*d*.

The slide plate 32*a* is a generally flat member and is located at a central portion of the sheet cassette 3 with respect to the paper width direction. The slide plate 32*a* is placed on the bottom plate 31*a* of the cassette body 31. While being guided by the guide groove 31*a*1, the slide plate 32*a* slides on the bottom plate 31*a*, whereby the slide plate 32*a* can be positioned at any position within the range of the guide groove 31*a*1.

The rear-end stopper plate 32*b* is a generally flat member and stands upward from the slide plate 32*a*. The rear-end stopper plate 32*b* is provided substantially perpendicular to the printer front-rear direction so as to butt against rear ends of image-recording media contained in the cassette body 31.

The slide plate 32*a* and the rear-end stopper plate 32*b* are integrally formed from a synthetic resin plate. The structure of contact between the slide plate 32*a* and the bottom plate 31*a* is such that, even when 200 sheets of paper of A4 size are placed in a bundle in the sheet cassette 3, and the rear ends of the 200 sheets of paper hit against the rear-end stopper plate 32*b*, the slide plate 32*a* does not move (e.g., a structure having a predetermined coefficient of friction or a structure having a ratchet mechanism).

Referring to FIG. 2, the rack gear 32*c* extends along the printer front-rear direction (along the first direction y1). The rack gear 32*c* is disposed externally of the side plate 31*b* of the cassette body 31.

Referring to FIG. 3, the rack gear 32*c* has a projection 32*c*1 formed at a near end portion thereof. The projection 32*c*1 projects upward beyond a gear portion of the rack gear 32*c*.

Referring to FIG. 2, the rack gear 32*c* and the slide plate 32*a* (the rear-end stopper plate 32*b*) are tied together via the tie bar 32*d* extending along the paper width direction.

The cassette body 31 has size indications 33 provided at an upper end portion of the side plate 31*b*. The size indications 33 correspond to standard sizes (A4, B5, A5, etc.) of image-recording media. In association with positioning of the sheet-position-limiting member 32 according to the amount of drawing of the sheet cassette 3 as will be described later, the size indications 33 indicate the relationship between the positions of the sheet-position-limiting member 32 and the amounts of drawing of the sheet cassette 3.

<Detailed Configuration for Positioning of Sheet-Position-Limiting Member>

Referring to FIG. 3, a stopper member 270, which serves as the limiting-member-positioning means of the present invention, is disposed at a lower portion of the body casing 21 substantially at the center with respect to the paper width direction.

The stopper member 270 is an actuator attached to an unillustrated solenoid and can be selectively positioned at a retreat position shown in FIG. 3 (*i*) or a butt position shown in FIG. 3 (*ii*).

The "butt position" is a position (first position) where, when the sheet cassette 3 is drawn out in the first direction y1, the stopper member 270 can butt against the rear-end stopper plate 32*b* of the sheet-position-limiting member 32. The "retreat position" is a position (second position) where, when the sheet cassette 3 is drawn out in the first direction y1, the stopper member 270 cannot butt against the rear-end stopper plate 32*b* of the sheet-position-limiting member 32.

As mentioned above, when the sheet cassette 3 is drawn out in the first direction y1, the stopper member 270 positioned at the butt position can butt against the rear-end stopper plate 32*b* of the sheet-position-limiting member 32.

That is, in a state in which the stopper member 270 is positioned at the butt position, and the sheet-position-limiting member 32 is positioned at the initial position shown in FIG. 3, when the sheet cassette 3 is drawn out further in the first direction y1, the stopper member 270 can butt against the rear-end stopper plate 32*b* of the sheet-position-limiting member 32.

In a state in which the stopper member 270 butts against the rear-end stopper plate 32*b* as mentioned above, when the sheet cassette 3 is drawn out further in the first direction y1, the stopper member 270 can cause the rear-end stopper plate 32*b* (the sheet-position-limiting member 32) to move in the second direction y2 in relation to the cassette body 31 of the sheet cassette 3.

In this manner, by means of causing the above-mentioned relative movement between the cassette body 31 and the rear-end stopper plate 32*b* (the sheet-position-limiting member 32), the stopper member 270 can position the rear-end stopper plate 32*b* (the sheet-position-limiting member 32) according to the amount of drawing of the sheet cassette 3.

<Detailed Configuration for Initializing Position of Sheet-Position-Limiting Member>

Figure 4:
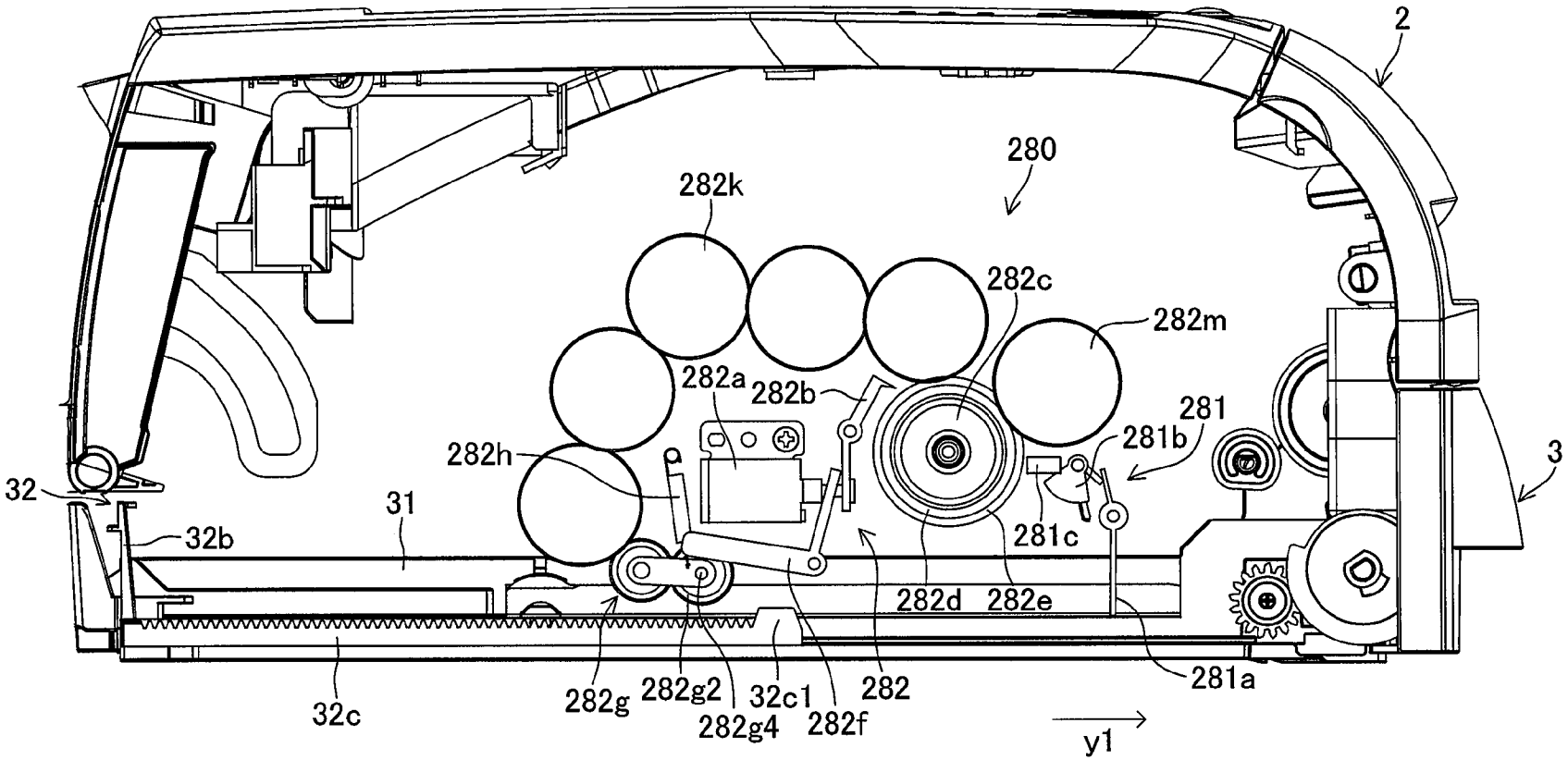
FIG. 4 is a side see-through view showing the configuration of a mechanism for initializing the position of a sheet-position-limiting member (for moving the sheet-position-limiting member to an initial position) shown in FIG. 1.

FIG. 4 shows, as viewed from the side and in a see-through manner, the configuration for initializing the position of the sheet-position-limiting member 32 shown in FIG. 1 (for moving the sheet-position-limiting member 32 to the initial position).

Referring to FIG. 4, a rear-end-stopper-plate-moving mechanism 280, which serves as the limiting-member-position-initializing means of the present invention, is disposed within the body section 2 such that the mechanism is located at an end portion (on a side where the rack gear 32*c* is provided) with respect to the paper width direction.

When the sheet cassette 3 is empty of image-recording media, the rear-end-stopper-plate-moving mechanism 280 can move the sheet-position-limiting member 32 in the first direction y1 to the above-mentioned initial position.

Figure 5:
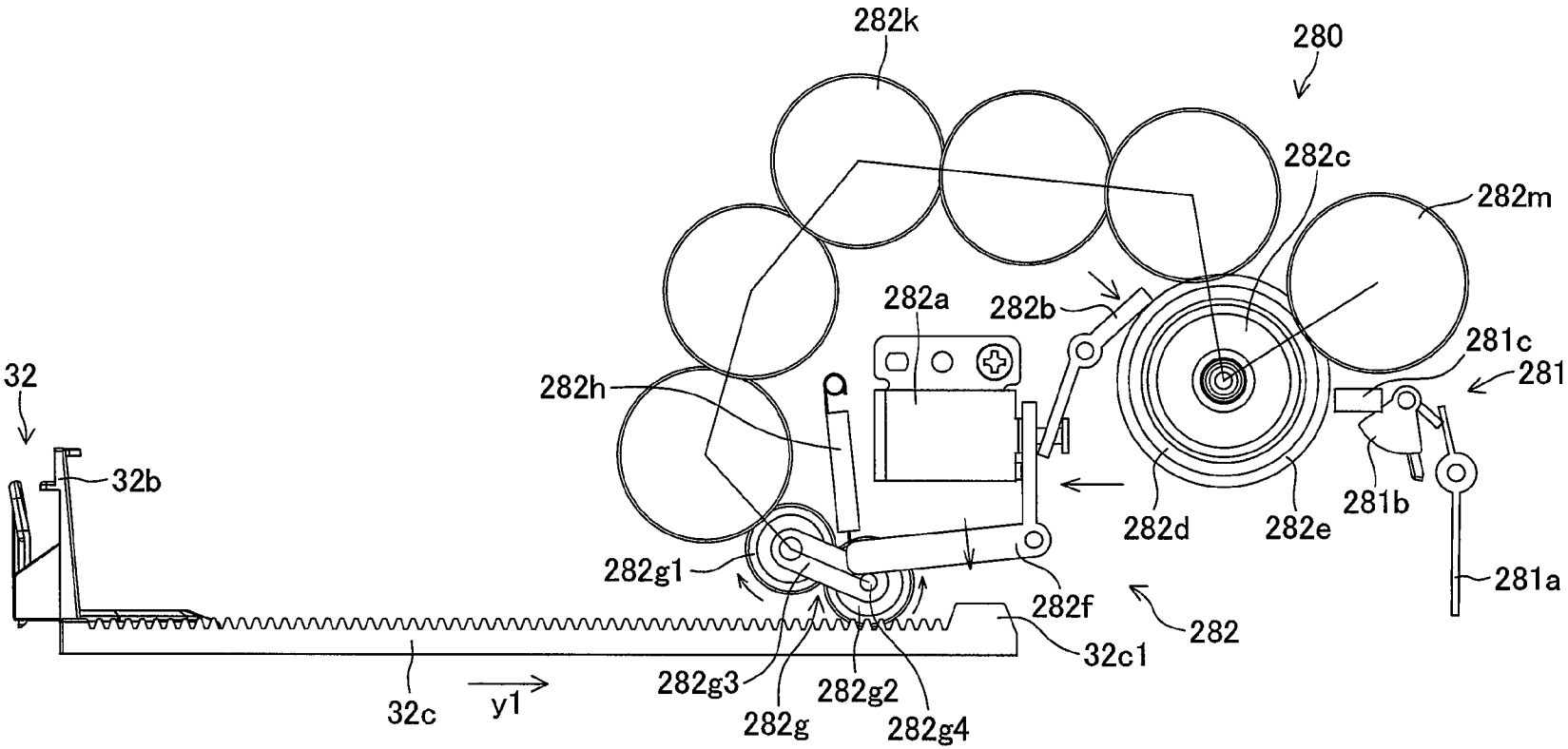
FIG. 5 is a side view showing, on an enlarged scale, the sheet-position-limiting member and a rear-end-stopper-plate-moving mechanism shown in FIG. 4.
Figure 6:
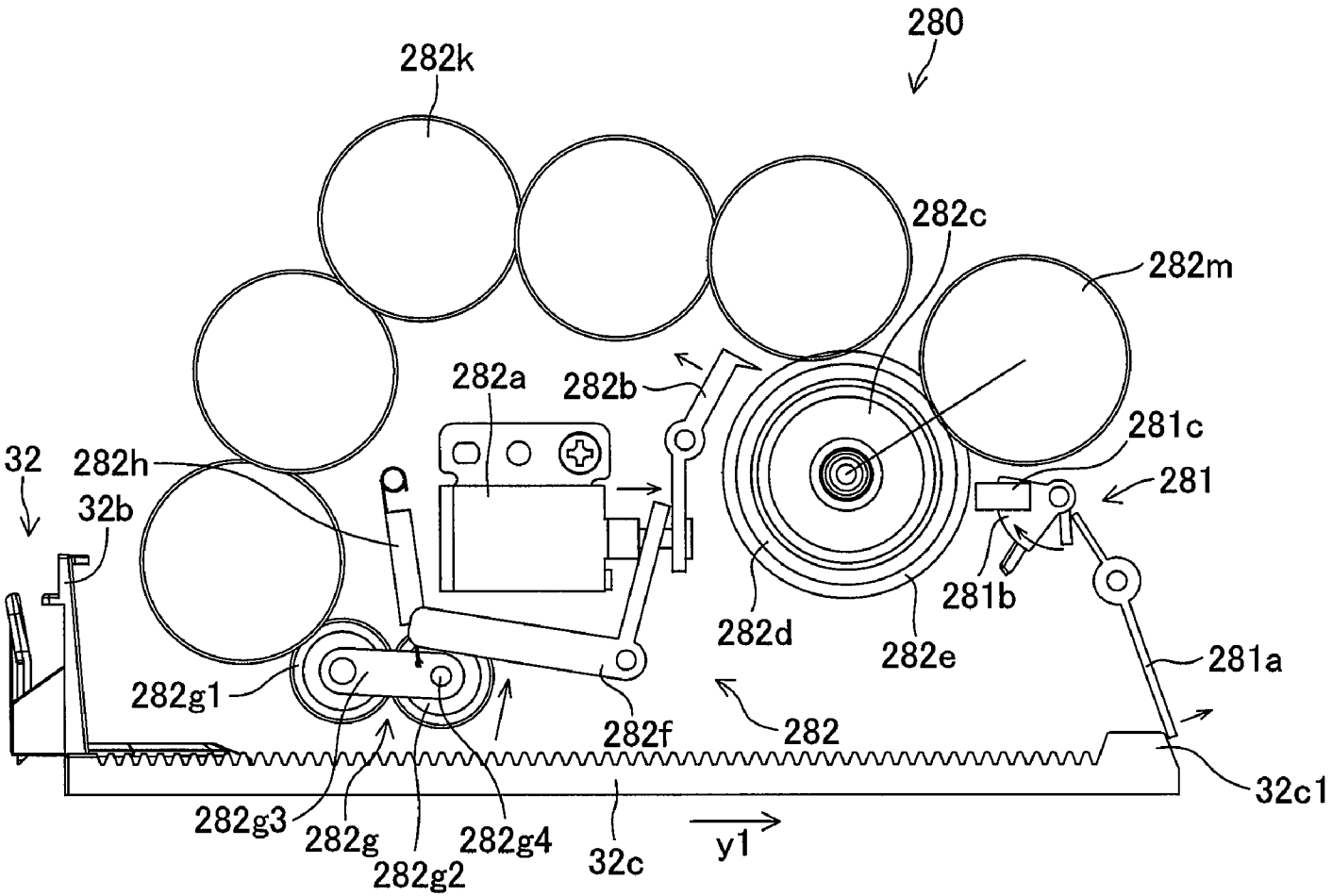
FIG. 6 is a side view showing, on an enlarged scale, the sheet-position-limiting member and the rear-end-stopper-plate-moving mechanism shown in FIG. 4.

FIGS. 5 and 6 show, on an enlarged scale and as viewed from the side, the sheet-position-limiting member 32 and the rear-end-stopper-plate-moving mechanism 280 shown in FIG. 4. The configuration of the rear-end-stopper-plate-moving mechanism 280 will next be described in detail with reference to FIGS. 4 to 6.

<<Paper Empty Sensor>>

A paper empty sensor 281 is disposed at a position corresponding to a near end portion of a space of the cassette body 31 in which image-recording media can be contained. The paper empty sensor 281 includes an actuator 281*a*, a swing intercepting plate 281*b*, and a photointerrupter 281*c*.

The actuator 281*a* is supported in such a manner as to be swingable about an axis of swing in parallel with the paper width direction. A lower portion (a portion located below the axis of swing) of the actuator 281*a* assumes a straight tongue-like shape as viewed from the side and is located within the space of the cassette body 31 which can contain image-recording media. An upper portion (a portion located above the axis of swing) of the actuator 281*a* assumes an upward-projecting tongue-like shape.

When the above-mentioned space is empty of image-recording media, the lower portion of the actuator 281*a* becomes parallel with the vertical direction as shown in FIG. 5 because of gravitational action. When the space contains image-recording media, the lower portion of the actuator 281*a* intersects with the vertical direction as shown in FIG. 6.

The swing intercepting plate 281*b* is disposed so as to face the tongue-like upper portion of the actuator 281*a*. As shown in FIGS. 5 and 6, the swing intercepting plate 281*b* is swingable in association with the swing of the upper portion of the actuator 281*a*.

As shown in FIG. 5, when the lower portion of the actuator 281*a* becomes parallel with the vertical direction, the swing intercepting plate 281*b* does not block an optical path of the photointerrupter 281*c*. As shown in FIG. 6, when the lower portion of the actuator 281*a* intersects with the vertical direction, the swing intercepting plate 281*b* blocks the optical path of the photo interrupter 281*c*.

<<Power Transmission Changeover Mechanism>>

The rear-end-stopper-plate-moving mechanism 280 includes a power transmission changeover mechanism 282. The power transmission changeover mechanism 282 is configured as described below so as to change power transmission modes according to the state of the paper empty sensor 281.

Energization of a solenoid 282*a* is controlled according to the state of the paper empty sensor 281. A clutch changeover arm 282*b* is attached to the solenoid 282*a*. The clutch changeover arm 282*b* can be engaged with a cylindrical outer casing of a planetary clutch 282*c*.

The planetary clutch 282*c* is configured such that a planetary gear mechanism is disposed within the cylindrical outer casing. The planetary clutch 282*c* can establish/cancel meshing between an input gear 282*d* and an output gear 282*e*. That is, the clutch changeover arm 282*b* and the planetary clutch 282*c* are configured and arranged so as to permit and stop transmission of power from the input gear 282*d* to the output gear 282*e* via the cylindrical planetary clutch 282*c*.

Specifically, the clutch changeover arm 282*b* and the planetary clutch 282*c* are configured such that, as shown in FIG. 5, when the clutch changeover arm 282*b* is engaged with the cylindrical outer casing of the planetary clutch 282*c* to thereby stop the rotation of the outer casing, power is transmitted from the input gear 282*d* to the output gear 282*e*.

Also, the clutch changeover arm 282*b* and the planetary clutch 282*c* are configured such that, as shown in FIG. 6, when the clutch changeover arm 282*b* is disengaged from the cylindrical outer casing of the planetary clutch 282*c*, transmission of power from the input gear 282*d* to the output gear 282*e* is shut off, and the outer casing rotates idle together with the input gear 282*d*.

In addition to the clutch changeover arm 282*b*, a pendulum-gear swing arm 282*f* is attached to the solenoid 282*a*. The pendulum-gear swing arm 282*f* can swing a pendulum gear 282*g* in association with activation of the solenoid 282*a*.

The pendulum gear 282*g* is disposed in such a manner as to face the rack gear 32*c*. The pendulum gear 232*g* includes a pinion drive gear 232*g*1, a pinion gear 282*g*2, a support plate 282*g*3, and a pin 282*g*4.

The pendulum gear 282*g* is configured such that a rotary center shaft of the pinion gear 282*g*2 is vertically swingable about a rotary center shaft of the pinion drive gear 282*g*1.

The pinion drive gear 282*g*1 and the pinion gear 282*g*2 are of the same shape. The pinion gear 282*g*2 is formed so as to mesh with the rack gear 32*c*. The pinion drive gear 282*g*1 and the pinion gear 282*g*2 are supported by the support plate 282*g*3 so as to mesh with each other.

The pin 282*g*4 is formed integrally with the rotary center shaft of the pinion gear 282*g*2. The pin 282*g*4 projects laterally from the support plate 282*g*3 and reaches a position located under the pendulum-gear swing arm 282*f*. At a position in the vicinity of the pin 282*g*4, the support plate 282*g*3 is elastically urged upward by means of a spring 282*h*.

As shown in FIG. 5, the pendulum-gear swing arm 282*f* presses the pin 282*g*4 downward, thereby causing the pinion gear 282*g*2 to lower and to mesh with the rack gear 32*c*. As shown in FIG. 6, upon cancellation of pressing the pin 282*g*4 down by the pendulum-gear swing arm 282*f*, the pinion gear 282*g*2 rises away from the rack gear 32*c*.

Transmission gears 282*k* are provided between the output gear 282*e* and the pinion drive gear 282*g*1 of the pendulum gear 282*g*. The output gear 282*e*, the transmission gears 282*k*, and the pinion drive gear 282*g*1 are configured and arranged so as to mesh with each other at all times.

A drive gear 282*m* is provided in such a manner as to mesh with the input gear 282*d* at all times. When an unillustrated main motor is operated, the drive gear 282*m* is rotatably driven at all times.

<Operations of Laser Printer of Present Embodiment>

Operations of the laser printer 1 having the above-described configuration will briefly be described with reference to the drawings.

<<Image-Forming Operation>>

Referring to FIG. 1, when the laser printer 1 receives an instruction to carry out printing, the paper feed mechanism 22 feeds image-recording media contained in the sheet cassette 3 one by one toward the process cartridge 23.

Meanwhile, the exposure unit 24 scans and irradiates the outer circumferential surface of the photoconductor drum 23*a* with a laser beam which is modulated according to image data. This forms an electrostatic latent image on the outer circumferential surface of the photoconductor drum 23*a*. The electrostatic latent image is developed by the developing unit 23*b*. That is, a charged toner adheres, in an image pattern, to the outer circumferential surface of the photoconductor drum 23*a*.

The toner adhering, in an image pattern, to the outer circumferential surface of the photoconductor drum 23*a* is transferred onto an image-recording medium, followed by subjection to heat and pressure applied by the fixation unit 25. This fixes the toner on the image-recording medium.

The image-recording medium which comes from the fixation unit 25 and on which the toner has been fixed is ejected toward the catch tray 21*a* through the paper ejection port 21*b*. Thus, paper on which an image has been formed is placed on the catch tray 21*a*.

<<Operation of Replenishing Empty Cassette with Image-Recording Media>>

An example operation will be described with respect to a case where the sheet cassette 3 has run out of A4 paper and is to be replenished with paper of a size smaller than A4.

Figure 7:
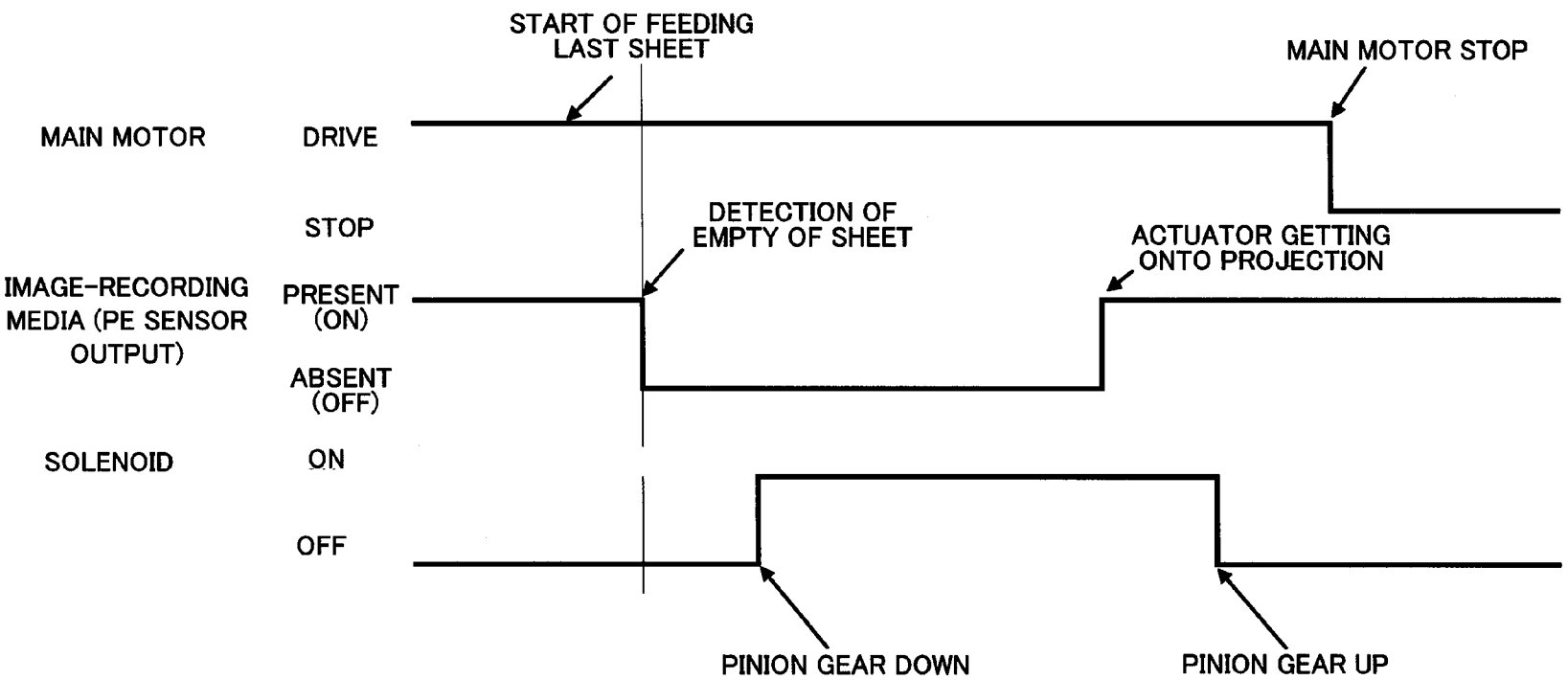
FIG. 7 is a time chart for explaining an example case where image-recording media have run out, and image-recording media of a smaller size are to be replenished.

FIG. 7 shows a time chart for explaining the operations. The operations will next be described with reference to FIGS. 2 to 7.

As shown in FIG. 4, when A4 paper contained in the sheet cassette 3 runs out, the lower portion of the actuator 281*a* of the paper empty sensor 281 becomes parallel with the vertical direction because of gravitational action. This unblocks the optical path of the photointerrupter 281*c*, thereby detecting that the sheet cassette 3 is empty. Upon detection of the sheet cassette 3 being empty, the solenoid 282*a* is energized.

As a result of energization of the solenoid 282*a*, as shown in FIG. 5, the clutch changeover arm 282*b* is engaged with the outer casing of the planetary clutch 282*c*. This causes the input gear 282*d* and the output gear 282*e* to mesh with each other. Thus, a rotational drive force is transmitted from the drive gear 282*m*, to which a rotational drive force is transmitted at all times from an unillustrated main motor, to the output gear 282*e* via the input gear 282*d* and the planetary clutch 282*c*.

The pendulum-gear swing arm 282*f* presses the pin 282*g*4 down against an elastic force of the spring 282*h*. This causes the pendulum gear 282*g* to swing such that the pinion gear 282*g*2 lowers. As a result of lowering of the pinion gear 282*g*2, the pinion gear 282*g*2 meshes with the rack gear 32*c*.

In this condition, a rotational drive force of the output gear 282*e* is transmitted to the pinion gear 282*g*2, thereby causing the rack gear 32*c* to move in the first direction y1. That is, the sheet-position-limiting member 32 moves in the first direction y1.

As shown in FIG. 6, when the sheet-position-limiting member 32 moves to the predetermined initial position, the lower portion of the actuator 281*a* of the paper empty sensor 281 gets onto the projection 32*c*1 formed at a longitudinal end of the rack gear 32*c*. This causes the lower portion of the actuator 281*a* to intersect with the vertical direction, whereby the optical path of the photointerrupter 281*c* is blocked. This de-energizes the solenoid 282*a*.

As a result, the clutch changeover arm 282*b* is disengaged from the outer casing of the planetary clutch 282*c*. This cancels meshing between the input gear 282*d* and the output gear 282*e*. Thus, the input gear 282*d* and the planetary clutch 282*c* rotate idle, thereby shutting off transmission of a rotational drive force to the output gear 282*e*.

Also, pressing the pin 282*g*4 down by the pendulum-gear swing arm 282*f* is canceled. When pressing the pin 282*g*4 down is canceled, an elastic force of the spring 282*h* causes the pendulum gear 282*g* to swing such that the pinion gear 282*g*2 rises. The rising of the pinion gear 282*g*2 disengages the pinion gear 282*g*2 from the rack gear 32*c*. Thus, the movement of the sheet-position-limiting member 32 in the first direction y1 ends.

Subsequently, the unillustrated main motor stops. Further, as shown in FIG. 3(*ii*), the stopper member 270 projects downward to the butt position.

Next, when the sheet cassette 3 is drawn out along the first direction y1, the stopper member 270 butts against the rear-end stopper plate 32*b*. When, with the stopper member 270 butting against the rear-end stopper plate 32*b*, the sheet cassette 3 is further drawn out in the first direction y1, the rear-end stopper plate 32*b* (the sheet-position-limiting member 32) moves in the second direction y2 in relation to the cassette body 31 of the sheet cassette 3.

The user adjusts the amount of drawing of the sheet cassette 3 while viewing the size indications 33 (see FIG. 2). This positions the rear-end stopper plate 32*b* (the sheet-position-limiting member 32) according to the amount of drawing of the sheet cassette 3.

As described above, the configuration of the present embodiment allows positioning of the sheet-position-limiting member 32 (the rear-end stopper plate 32*b*) merely by adjusting the amount of drawing of the sheet cassette 3. That is, a manual operation performed by the user for changing sizes of image-recording media can be completed merely by drawing of the sheet cassette 3, which is a minimal requisite for changing the sizes. Therefore, an operation for changing sizes of image-recording media is more simplified.

When the sheet cassette 3 is to be completely removed from the body section 2, as shown in FIG. 3 (*i*), the stopper member 270 is raised to the retreat position. In this case, raising the stopper member 270 is executed when the user inputs a predetermined instruction from an unillustrated operation panel provided on the body casing 21.

In the case where the sheet cassette 3 becomes empty and is to be replenished with image-recording media without changing the size, even when the fact the sheet cassette 3 is empty is detected, the solenoid 282*a* (see FIG. 4) is not energized, and the stopper member 270 is positioned at the retreat position (see FIG. 3 (*i*)). In this case, rendering the solenoid 282*a* de-energized and positioning the stopper member 270 at the retreat position are also executed when the user inputs a predetermined instruction from the unillustrated operation panel provided on the body casing 21.

<Modifications>

The above-described embodiment is a mere example of the best mode which the inventors of the present invention contemplated at the time of filing the present application. The present invention is not limited to the above-described embodiment. Various modifications to the above-described embodiment are possible, so long as the invention is not modified in essence.

Modifications to the above-described embodiment will next be exemplified. In the following description of the modifications, members similar in structure and function to those used in the above-described embodiment are denoted by the same reference numerals as those used in the above-described embodiment. As for the description of these members, an associated description appearing in the description of the above-described embodiment can be cited, so long as no technical inconsistencies are involved.

Needless to say, modifications are not limited to those exemplified below. Also, a plurality of modifications can be combined as appropriate, so long as no technical inconsistencies are involved.

The above-described embodiment and the following modifications should not be construed as limiting the present invention (particularly, those components which partially constitute the means for achieving the object of the present invention and are described operationally or functionally). Such limiting construal unfairly impairs the interests of an applicant (who is motivated to file as quickly as possible under the first-to-file system) while unfairly benefiting imitators, and is thus impermissible.

(a) An application of the present invention is not limited to a laser printer. For example, the present invention is applicable to facsimile, copying machines, etc. Also, the present invention is widely applicable to image-forming apparatus having an image-forming section of a type (an ink jet type, an ion flow type, a toner jet type, or the like) other than an electrophotographic type.

(b) The maximum paper size for the laser printer 1 is not limited to A4 size in portrait orientation. For example, the maximum paper size may be the legal size.

The minimum paper size for the laser printer 1 is not limited to A5 size in portrait orientation. That is, the initial position is not limited to the position associated with A5 paper in portrait orientation. For example, the minimum paper size may be A5 size in landscape orientation or A6 size in portrait orientation.

(c) The above embodiment is described while mentioning a solenoid-employed mechanism for selectively positioning the stopper member 270 at the butt position or at the retreat position. However, the present invention is not limited thereto. For example, a motor and a cam may be employed.

Alternatively, a positioning mechanism for the stopper member 270 may be such that the user manually position the stopper member 270 selectively at the butt position or at the retreat position. In this case, for example, the positioning mechanism may be such a toggle mechanism that, each time the user operates a lever or a button, the position of the stopper member 270 alternates between the butt position and the retreat position. This improves the operability of positional switching for the stopper member 270.

(d) The structure of the paper empty sensor 281 is not limited to that of the above embodiment. For example, the swing intercepting plate 281*b* may be eliminated. Specifically, the actuator 281*a* may have such a structure that an upper portion of the actuator 281*a* can block the optical path of the photointerrupter 281*c*.

(e) Also, the structures of the sheet-position-limiting member 32, the stopper member 270, and the rear-end-stopper-plate-moving mechanism 280 for initializing the position of the sheet-position-limiting member 32 and moving the sheet-position-limiting member 32 to predetermined positions are not limited to those disclosed in the above-described embodiments.

Figure 8:
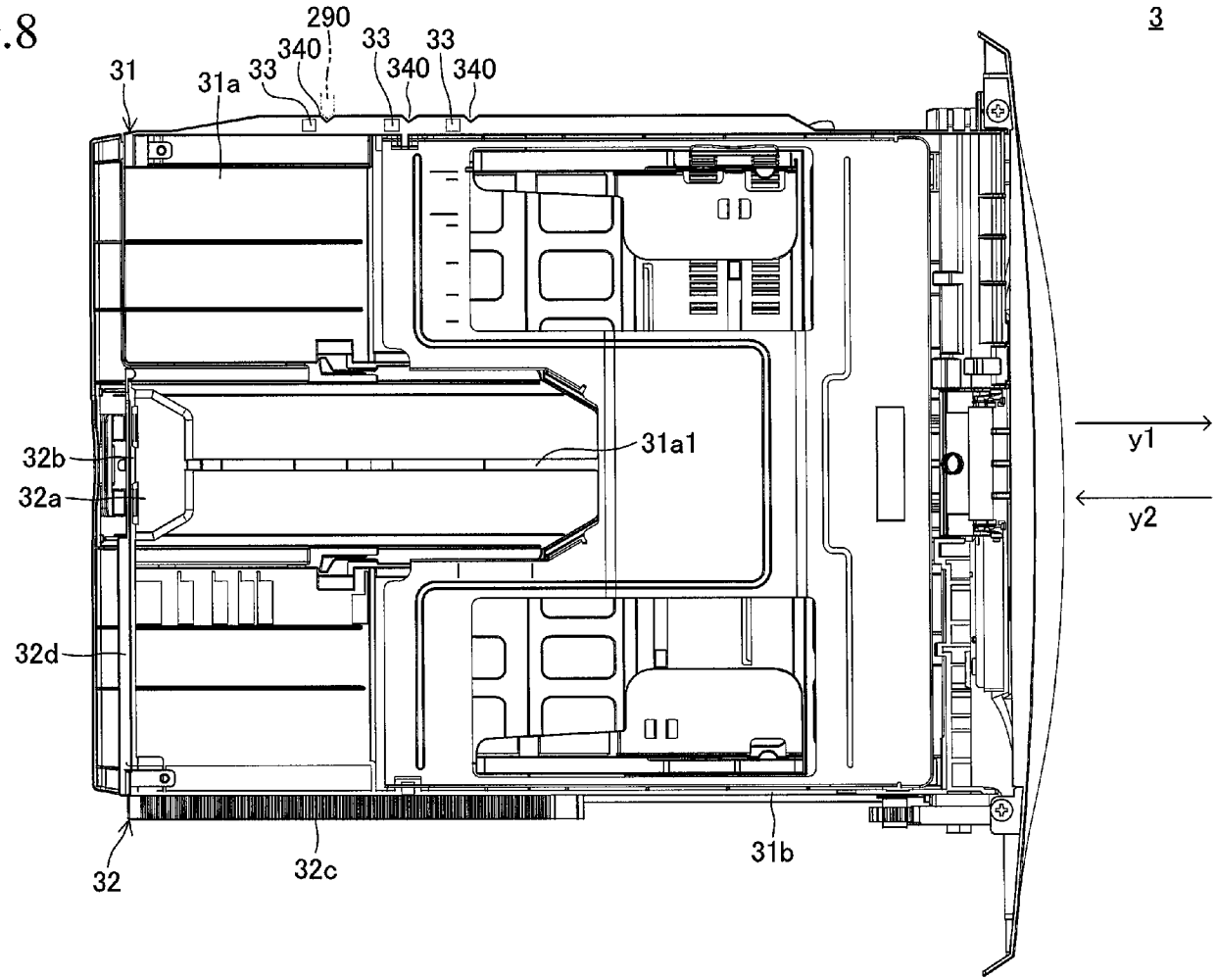
FIG. 8 is a plan view showing the configuration of a modification of the sheet cassette shown in FIG. 3.

(f) FIG. 8 is a plan view showing a modified configuration of the sheet cassette 3 shown in FIG. 3.

Referring to FIG. 8, the sheet cassette 3 may have recesses 340 each of which can be engaged with a projection 290 provided in the interior of the body section 2 (see FIG. 1) and projecting laterally. This structural feature can render simpler and more reliable an adjustment in the amount of drawing of the sheet cassette 3.

The structural feature shown in FIG. 8 may be reversed; i.e., the sheet cassette 3 has a projection, and the body section 2 has recesses.

(g) In place of the size indications 33 provided on the cassette body 31, an electronic indication of liquid crystal or the like may be provided on the near-side surface of the body casing 21. This case requires amount-of-drawing detection means for detecting the amount of drawing of the sheet cassette 3. The amount-of-drawing detection means includes, for example, means for detecting a state of engagement (the position of engagement or the number of times of engagement) between the projection 290 and one of the recesses 340.

(h) Those components which partially constitute the means for achieving the object of the invention and are operationally or functionally described encompass not only the specific structures disclosed in the above-described embodiment and modifications, but also any other structures that provide the same or similar operations or functions.

What is claimed is:

1. An image-forming apparatus comprising:

a sheet cassette capable of containing sheets of image-recording media in a stacked condition, and a body section accommodating the sheet cassette such that the sheet cassette can be drawn out along a first direction, wherein the sheet cassette comprises:

a cassette body, and a sheet-position-limiting member capable of being positioned according to a size of the image-recording media contained in the cassette body through movement in relation to the cassette body in the first direction or a second direction opposite the first direction; and the body section comprises:

limiting-member-position-initializing member configured to move the sheet-position-limiting member in the first direction to a predetermined initial position when the sheet cassette is empty of the image-recording media, and a limiting-member-positioning member configured to set the position of the sheet-position-limiting member according to an amount of drawing of the sheet cassette by means of ausing the sheet-position-limiting member to move in the second direction in relation to the sheet cassette when the sheet cassette is drawn out in the first direction with the sheet-position-limiting member positioned at the predetermined initial position;

wherein the limiting-member-positioning member comprises a stopper member capable of butting against the sheet-position-limiting member when the sheet cassette is drawn out in the first direction.

2. An image-forming apparatus according to claim 1, wherein:

the cassette body comprises:

a bottom plate, and side plates standing upward from respective end portions of the bottom plate, and the sheet-position-limiting member is slidably attached to the bottom plate.

3. An image-forming apparatus according to claim 2, wherein:

the sheet-position-limiting member comprises a rack gear extending along the first direction, and the limiting-member-position-initializing member comprises a pinion gear, wherein the pinion gear is meshed with the rack gear when the sheet cassette is empty of the image-recording media.

4. An image-forming apparatus according to claim 1, wherein the limiting-member-positioning member is configured such that the stopper member can be selectively positioned at either a first position or a second position, the first position being where the stopper member can butt against the sheet-position-limiting member when the sheet cassette is drawn out in the first direction, and the second position being where the stopper member cannot butt against the sheet-position-limiting member when the sheet cassette is drawn out in the first direction.

5. An image-forming apparatus according to claim 4, wherein the sheet cassette comprises size indications indicative of the relationship between amounts of drawing of the sheet cassette and positions of the sheet-position-limiting member corresponding to standard sizes of the image-recording media.

6. An image-forming apparatus according claim 5, wherein:

the sheet cassette comprises recesses, and the body section comprises a projection to be engaged with any one of the recesses.

7. An image-forming apparatus comprising:

a sheet cassette capable of containing sheets of image-recording media in a stacked condition, and a body section accommodating the sheet cassette such that the sheet cassette can be drawn out along a first direction, wherein the sheet cassette comprises:

a cassette body comprising:

a bottom plate, and side plates standing upward from respective end portions of the bottom plate, and wherein the sheet-position-limiting member is slidably attached to the bottom plate, and a sheet-position-limiting member comprising a rack gear extending along the first direction and capable of being positioned according to a size of the image-recording media contained in the cassette body through movement in relation to the cassette body in the first direction or a second direction opposite the first direction; and the body section comprises:

a limiting-member-position-initializing member comprising a pinion gear and configured to move the sheet-position-limiting member in the first direction to a predetermined initial position when the sheet cassette is empty of the image-recording media, and a limiting-member-positioning member configured to set the position of the sheet-position-limiting member according to an amount of drawing of the sheet cassette by means of ausing the sheet-position-limiting member to move in the second direction in relation to the sheet cassette when the sheet cassette is drawn out in the first direction with the sheet-position-limiting member positioned at the predetermined initial position;

wherein the pinion gear is meshed with the rack gear when the sheet cassette is empty of the image-recording media; and wherein the limiting-member-positioning member comprises a stopper member capable of butting against the sheet-position-limiting member when the sheet cassette is drawn out in the first direction.

8. An image-forming apparatus according to claim 1, wherein the limiting-member-positioning member is configured such that the stopper member can be selectively positioned at either a first position or a second position, the first position being where the stopper member can butt against the sheet-position-limiting member when the sheet cassette is drawn out in the first direction, and the second position being where the stopper member cannot butt against the sheet-position-limiting member when the sheet cassette is drawn out in the first direction.

9. An image-forming apparatus according to claim 8, wherein the sheet cassette comprises size indications indicative of the relationship between amounts of drawing of the sheet cassette and positions of the sheet-position-limiting member corresponding to standard sizes of the image-recording media.

10. An image-forming apparatus according to claim 9, wherein:

the sheet cassette comprises recesses, and the body section comprises a projection to be engaged with any one of the recesses.

* * * * *